United States Patent [19]

Peek

[11] Patent Number: 4,697,395

[45] Date of Patent: Oct. 6, 1987

[54] PREUPLIFT TECHNIQUE OF ANCHORING A CYLINDRICAL LIQUID STORAGE TANK FOR LATERAL LOADING

[75] Inventor: Ralf Peek, Orinda, Calif.

[73] Assignee: California Institute of Technology, Pasadedena, Calif.

[21] Appl. No.: 899,516

[22] Filed: Aug. 22, 1986

[51] Int. Cl.[4] ..... E04H 9/02; E02D 27/38

[52] U.S. Cl. ..... 52/167; 52/169.7; 52/245

[58] Field of Search ..... 52/167, 169.7, 169.8, 52/245; 220/1 B

[56] References Cited

U.S. PATENT DOCUMENTS

| | | | |
|---|---|---|---|
| 3,977,140 | 8/1976 | Matsudaira et al. | 52/167 |
| 4,249,352 | 2/1981 | Marchaj | 52/167 |
| 4,267,676 | 5/1981 | Marchaj | 52/167 |
| 4,315,385 | 2/1982 | Moreau et al. | 52/167 X |

FOREIGN PATENT DOCUMENTS

| | | | |
|---|---|---|---|
| 6115 | 1/1977 | Japan | 220/1 B |
| 124314 | 10/1978 | Japan | 52/167 |
| 675138 | 7/1979 | U.S.S.R. | 52/167 |

OTHER PUBLICATIONS

"Failure of Liquid Storage Tanks Due to Earthquake Excitation", by Choon-Foo Shih California Institute of Technology, Earthquake Engineering Research Laboratory, CIT Report No. EERL81-04, 1981.

"Matrix Analysis of Shell Structures", by Stanley Klein, Massachusetts Institute of Technology, Department of Aeronautics, ASRL-TR-121-12, 1964.

"Computerized Analysis of Shells—Governing Equations", by David Bushnell, Lockheed Palo Alto Research Laboratory, Applied Mechanics Laboratory, Technical Report AFWAL-81-3048, 1981.

CBI Standard 541-1, Shimming, Grouting, and Sealing Tanks on Concrete Foundations," p. 21, Nov. 60 (Rev. Mar. 81).

"AWWA D100-84 Standard" Welded Steel Tanks, pp. 44-45, date unknown.

*Primary Examiner*—Alfred C. Perham

*Attorney, Agent, or Firm*—Paul R. Wylie

[57] ABSTRACT

Unanchored fluid storage tanks rely primarily on the weight of fluid resting on an uplifted portion of the base plate to balance seismically induced overturning moments. Local uplift is therefore necessary to develop the resisting moment. This has often resulted in buckling and other damage. These problems are reduced or eliminated by inserting a ring filler under the tank wall, so that the base plate is partly preuplifted. The weight of fluid resting on the preuplifted portion of the base plate can contribute to the resisting moment without any additional uplift of the tank wall. It is shown by static analysis and by experiment that preuplift significantly improves the lateral load capacity of unanchored tanks.

4 Claims, 9 Drawing Figures

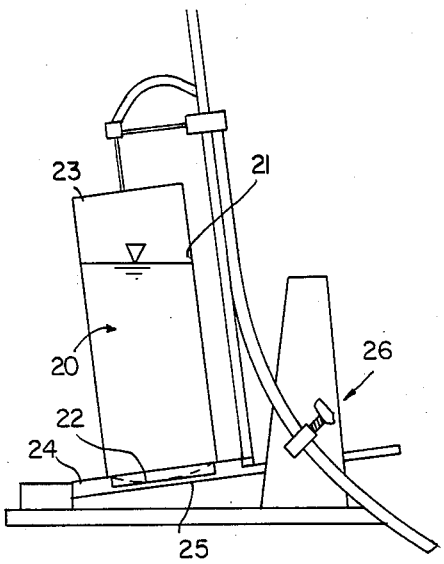
FIG .3
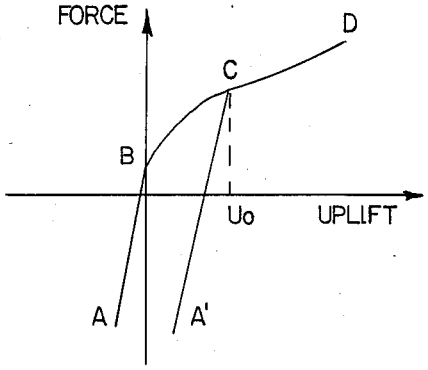
FORCE DEFLECTION RELATION WITHOUT PREUPLIFT (CURVE ABCD) AND WITH PREUPLIFT $U_0$ (CURVE A' CD)
FIG. 4
FIG. 5
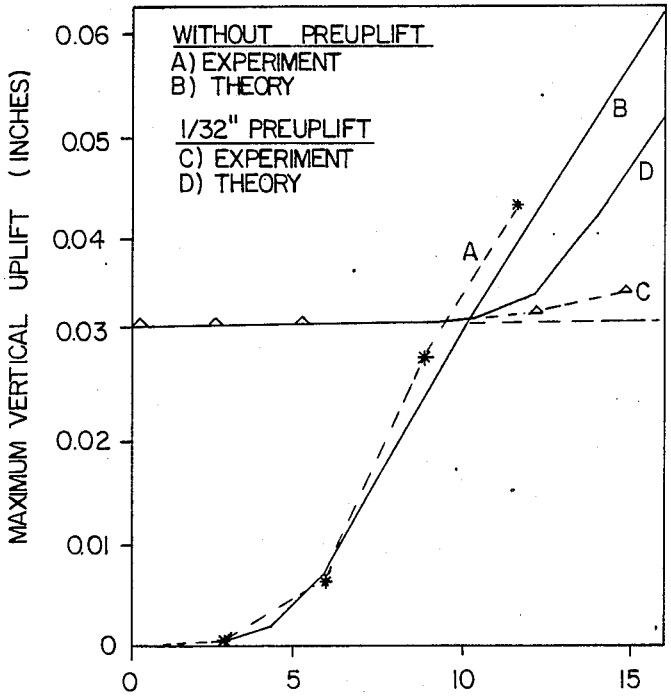
UPLIFT VERSUS TILT ANGLE FOR THE MYLAR TANK FILLED WITH WATER TO A DEPTH OF 4.9/16".

THEORETICAL DISTRIBUTION OF VERTICAL STRESSES IN THE TANK WALL AT THE BASE

WATER DEPTH AT BUCKLING VERSUS TILT ANGLE FROM THE EXPERIMENTS AND THE APPROXIMATE ANALYSIS WITH THE CLASSICAL BUCKLING CRITERION.

FIG. 8
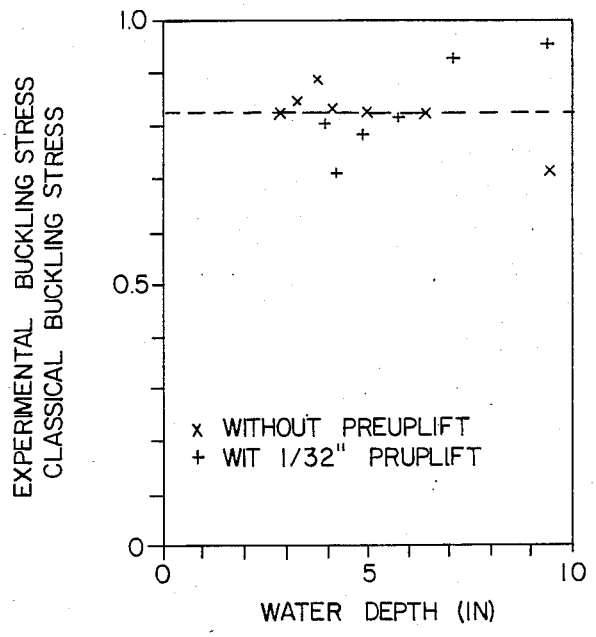
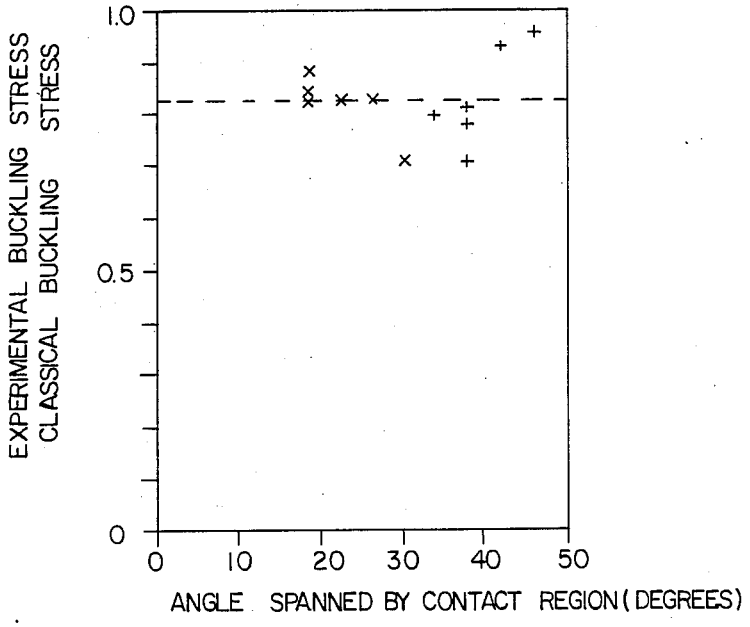
FIG. 9

PREUPLIFT TECHNIQUE OF ANCHORING A CYLINDRICAL LIQUID STORAGE TANK FOR LATERAL LOADING

BACKGROUND OF THE INVENTION

Origin of the Invention

The present invention was made under National Science Foundation Grant No. CEE-8119962 and is subject to the provisions of the National Science Foundation Act.

Because of cost, many ground supported fluid storage tanks are not anchored to their foundations, even in seismic areas. This is especially true for large capacity, broad tanks. When such an unanchored tank is subjected to strong ground shaking, the lateral force due to hydrodynamic pressures acting on the tank wall is of the same order of magnitude as the weight of the liquid. Unless a portion of the tank wall uplifts, the overturning moment induced by this lateral force can only be balanced by the stabilizing effect of the weight of the tank. For typical steel tanks the weight of the tank is much less than the weight of the contained liquid. Therefore, the weight of the tank is insufficient to balance the overturning moment due to hydrodynamic pressures acting on the tank wall, and the tank wall uplifts locally. As a result, a crescent-shape strip of the base plate is also lifted from the foundation. The weight of fluid resting on the uplifted portion of the base plate then provides the resisting moment against further uplift.

Unanchored tanks are special in that only the weight of fluid resting on the uplifted portion of the base plate contributes to the stabilizing moment, whereas the entire mass of fluid contributes to the overturning moment. This is different from the usual case in which the entire weight of a structure and its contents contributes to the stabilizing moment. As a result, unanchored fluid storage tanks are particularly prone to uplift problems.

Evidence of uplift can be found in the 1964 Alaska earthquake, during which snow found its way underneath the base plate of some tanks and during the 1971 San Francisco earthquake, when an anchor bolt of a 30 ft. tall and 100 ft. diameter tank was pulled up by 14".

The previously known established method of analysis for unanchored tanks is that developed by Wozniak, R. S. and Mitchell, W. W. (1978), "Basis of Seismic Design Provisions for Welded Oil Storage Tanks," Advances in Storage Tank Design, API, 43rd Midyear Meeting, Toronto, Ontario, Canada, however this work does not generally provide comprehensive methods for analysis of unanchored tanks and validation by experimental results. Various solutions to the problem of earthquake resistance in tanks have been suggested in U.S. Pat. No. 3,977,140 to Matsudaira, et al, U.S. Pat. No. 4,249,352 and U.S. Pat. No. 4,267,676 to Marchaj. However, these prior art patents all relate to bonding means or dampers and do not relate to unanchored storage tanks.

Although uplift itself is not necessarily associated with serious damage, it can be accompanied by large deformations and by major changes in the stresses in the shell of a tank. Experience in earthquakes has shown that the consequences of large uplift can include: (i) damage and breakage of connecting pipes; and (ii) buckling of the tank wall because the vertical compressive stress in the portion of the wall which remains in contact with the ground on the other side of the tank is greatly increased.

BRIEF DESCRIPTION OF THE INVENTION

The present invention and the preuplift concept embodied therein are the results of a broader study than that heretofore accomplished aimed at developing more comprehensive methods for the analysis of unanchored tanks and validating such methods by comparison with experimental results.

It appears, according to the invention, that the undesirable consequences of uplift of on unanchored tanks can be eliminated, or at least greatly reduced, if the tank wall is preuplifted all around its circumference by a ring filler.

The ring filler of the invention is designed in such a way that it carries not only the weight of the tank wall and roof, but also the weight of part of the fluid resting on the preuplifted portion of the base plate. For uplift to occur, this pre-load on the ring filler must be overcome by the seismically-induced vertical tension in the shell wall. Thus, for light to moderate ground shaking the tank wall remains in contact with the ring filler all around its circumference, and the tank behaves essentially as if it were anchored even under shaking that would otherwise cause substantial uplift. Moreover, it will be seen that even under ground shaking strong enough that the tank wall locally looses contact with the ring filler (i.e., major amounts of uplift), preuplift improves the performance of the tank for any given lateral load. This conclusion is supported by experimental and theoretical results.

In its method aspects, the invention relates to the method of providing stability for unanchored fluid storage tanks of the type having upstanding side walls and a ground supported base plate so that seismically induced overturning moments will be balanced. The method includes inserting a ring filler under the tank wall to partly preuplift the base plate whereby the weight of the fluid resting on the preuplifted portion of said base plate will contribute to the resisting moment to the seismically induced overturning moment without any additional uplift of the tank wall.

The invention also includes a combination of an unanchored fluid storage tank and a preuplift means to balance the seismically induced overturning moments wherein said tank, which has upstanding side walls and a ground supported base plate, has a ring filler inserted under the upstanding side wall to preuplift the base plate in an area adjacent to the side wall whereby the preuplifted portion will contribute to the resisting moment to a seismically induced overturning moment without any additional uplift of the tank wall.

It was an object of this invention to provide stability for unanchored fluid storage tanks without the use of anchoring means.

It was a further object of this invention to provide stability for unanchored fluid storage tanks by an inexpensive means that could be effectively installed in the field.

These and other objects will be more fully understood with reference to the drawings and the following detailed description of the invention.

DESCRIPTION OF THE DRAWINGS

Referring to the drawings:

FIG. 3 is an elevation view of a test apparatus according to the invention;

FIG. 4 is a plot showing the force deflection relation with and without preuplift;

FIG. 5 is a plot showing uplift versus tilt angle of the experimental apparatus according to the invention;

FIG. 8 is a plot of experimental buckling stress versus water depth; and

FIG. 9 is a plot of experimental buckling stress versus angle span by contact region.

DETAILED DESCRIPTION OF THE INVENTION

Figure 1:
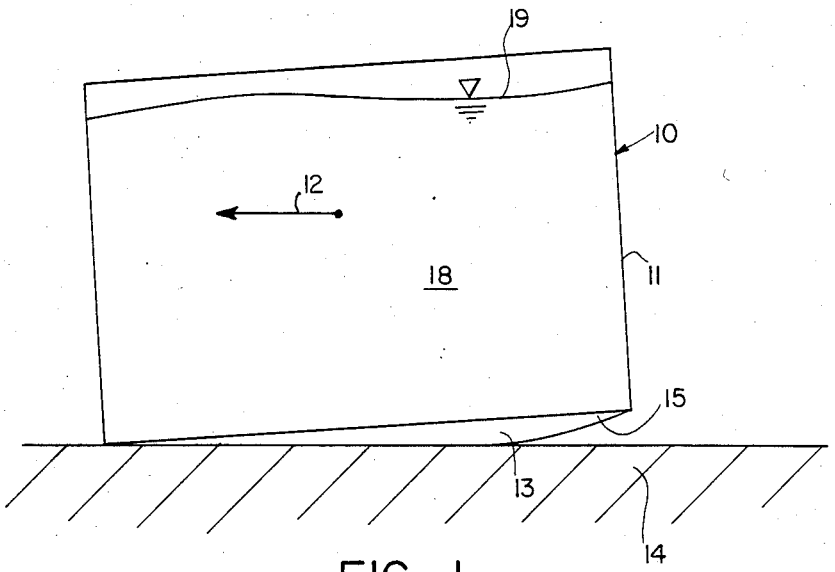
FIG. 1 is a schematic side elevation view of an unanchored fluid storage tank showing the results of seismic activity without the preuplift feature of this invention.

Referring now to the drawings, FIG. 1 illustrates schematically an unanchored fluid storage tank 10 showing, as a result of seismic activity, an uplifted side wall 11. A force due to seismic activity is indicated by arrow 12. This force gives rise to an overturning moment. The base plate 13 which normally rests on the ground 14 is shown as having been uplifted such that a crescent shape strip 15 of said base plate 13 is lifted.

Figure 2:
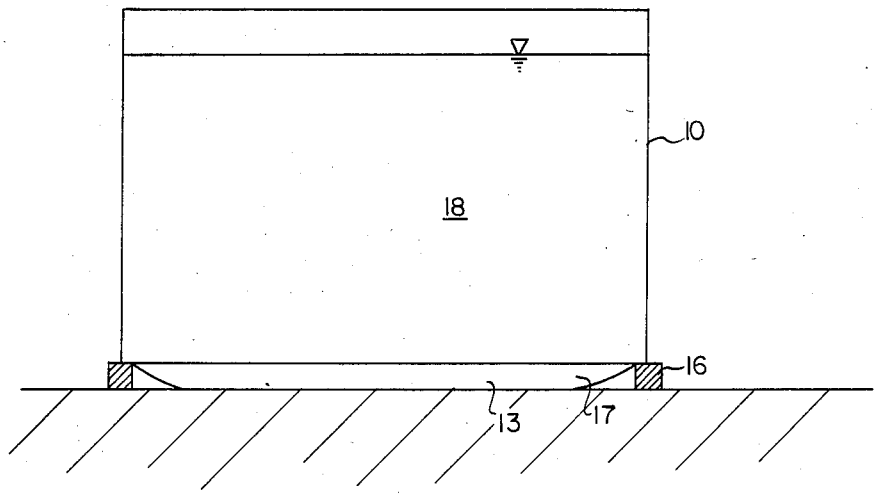
FIG. 2 is a view similar to FIG. 1 showing the ring filler used to preuplift the base plate of an unanchored storage tank.

In FIG. 2, a ring filler 16, according to the invention, has been inserted under side wall 10 to preuplift a portion 17 of base plate 13. The ring filler 16 is cylindrical in shape and extends continuously around the periphery of side wall 10.

In the test apparatus of FIG. 3, a mylar tank 20 is shown which was fabricated following the methods of Shih, C. F. (1981), "Failure of Liquid Storage Tanks Due to Earthquake Excitation", Earthquake Engineering Research Laboratory, California Institute of Technology, Report No. EERL 81-04. The tank was constructed with a vertical seam in the tank wall 21 lapped and bonded with ¼" wide double sided tape. At the junction between the tank wall 21 and the base plate 22 (henceforth referred to as the edge), a thin bead of epoxy was used as a bonding agent. At the top, a lucite ring 23 was used to prevent any out-of-round deformations of the cross section.

The dimensions for the model tank 20 were 5" for the diameter 9⅞" for the height, and 0.002" for the thickness of both the tank wall 21 and the base plate 22. Since the modulus of elasticity for mylar is approximately 735,000 psi a factor of 40 less than that for steel, the model tank 20 satisfies the conditions of similarity with a steel tank 40 times larger. This means that the hypothetical steel prototype is 16'-18" in diameter, 32'11" tall, and both the tank wall and the base plate are 0.08" thick. This shell thickness is close to the minimum that would be required to support the hydrostatic water pressure if the tank is full.

A ring filler 24 was used to provide preuplift under tank 20. The ring filler 24 consisted of a 1/32" thick square sheet of plexiglass with a hole of diameter of few hundredths of an inch less than the inner diameter of the tank 20. This insured that the entire circumference of the tank wall is supported by the filler even if there is small error in centering the filler. To prevent slippage, the tank 20 was bonded to its foundation 25 at the center by a ¼" square piece of double sided tape.

A static lateral load was induced by tilting the tank 20 on a tilt table 26 which was designed for calibrating accelerometers. In doing so, the vertical lap joint in the shell was oriented on the axis of loading, opposite to the region of vertical compression. Two types of tests were performed:

(i) The tank was filled with water to a depth of 49/16" at zero tilt and the tilt angle was increased at each increment of about 3°, measuring the maximum uplift at each increment with feeler gauges. The results are shown in FIG. 5.

Figure 7:
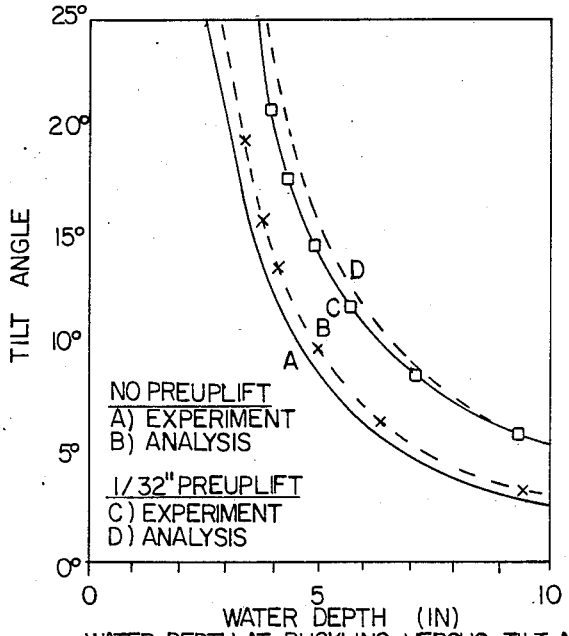
FIG. 7 is a plot of water depth at buckling versus tilt angle for the experimental apparatus according to the invention.

(ii) The tilt angle was held fixed, and the tank was filled slowly through an aluminum tube until the first signs of a buckle could be detected visually, using light reflected on the tank wall. The water levels at buckling are shown in FIG. 7 for various tilt angles. Each experimental point is the average of two readings.

In the buckling tests, the first buckle always formed near the base 22, at the axis of loading. If the water level was increased further, the buckle gradually increased in size and more buckles formed. This agrees with prior art observations that unanchored tanks do not collapse for water levels significantly higher than the water level at which the first buckle can be detected. However, in contrast to the prior art which measured collapse water levels, all experimental data according to this invention relate to incipient buckling. This would seem to be a more appropriate failure criterion, because mylar tanks would appear to owe much of their post buckling strength to the fact that the mylar does not yield at stress levels which, when scaled to prototype stresses, are well above the yield stress for the mild steels out of which storage tanks are typically made.

In the analysis of the test data, the cylindrical tank wall 21 is modeled with axisymmetric shell elements and an expansion of the displacements as a Fourier series in the circumferential direction. For shells of revolution, this formation is efficient, and has been used in the prior art such as described by Klein, S. (1964), "Matrix Analysis of Shell Structures", S.M. Thesis, ASRL-TR-121-12, Department of Aeronautics and Astronautics, MIT, Cambridge, Mass., June. Geometrically nonlinear effects are included in the formulation of the shell problem. However, the nonlinear shell problem is linearized about the full, but otherwise not loaded (or tilted) configuration. The underlying assumption is that the hydrodynamic pressures (or the changes in pressure due to tilting) are small compared to the hydrostatic pressures.

For the base plate 22, two methods of analysis are used; an approximate one in which the axisymmetric solution is used to obtain a relationship between the vertical force and deflection at the base, and a more comprehensive one. Both are based on the nonlinear Von Karman plate theory. This theory is valid for moderate deflections, those which may be large compared to the thickness of the plate, but are small compared to other dimensions (such as the width of the uplifted strip, for the base plate problem).

A solution to the nonlinear contact problem of the partly uplifted base plate that can be obtained without a very large computational effort is the axisymmetric solution in which the tank wall is uplifted uniformly all around the circumference. This solution yields a relationship between the vertical uplifting force applied at the edge and the vertical uplift; that is, a relationship between the hold-down force per unit length and the uplift.

In strict terms, the solution to the axisymmetric problem is not applicable if the uplift varies around the circumference. However, if the uplifted width is small compared to the radius of the tank, and if the variations in vertical uplift are gradual, if would seem that the relation between the hold-down force per unit length and the vertical uplift determined from the axisymmetric solution may be approximately applicable at any give point on the circumference. Thus, the solution to the axisymmetric problem can be used in an approximate method of analysis to define the force-deflection relation for a ring of equivalent nonlinear Winkler springs at the base of the tank. This will be referred to as the assumption of weak circumferential variations in the base plate.

For the axisymmetric analysis, two methods were used: The shooting method (or forward integration) in which the boundary value problem is solved as an initial value problem, and the finite difference energy method (FDEM) used by Bushnell, D. (1981), "Computerized Analysis of Shells - Governing Equations", Technical Report AFWAL-81-3048, Appl. Mech. Lab., Lockheed Palo Alto Res. Lab., Palo Alto, Calif. The methods gave almost identical results. A typical relationship between the vertical uplifting force applied at the edge and the vertical uplift is shown by curve BCD in FIG. 4. For large uplift, the base plate carries the fluid pressure load mostly by membrane action.

According to the analytical technique of the invention, a tank such as 10 or 20 can be considered as a tank for which the base plate has been replaced by a ring of nonlinear Winkler springs. The force per unit length-deflection relationship for such springs is shown schematically in Fig. 4. For a tank without preuplift, the applicable curve is ABCD. The segment BCD of this curve is obtained from the axisymmetric uplift solution, and segment AB is taken to be linear, with a slope k that is representative of the stiffness of the foundation in compression. In the analysis set out herein a large number, $k_e = 10^6$ lb/in$^2$, is used to stimulate a rigid foundation.

Preuplift can be accounted for simply by modifying the force-deflection relation to the Winkler springs. In this case, the force-deflection relation is represented by curve A'CD in FIG. 4, in which the segment A'C is taken to be a straight line of slope k, representative of the flexibility of the foundation and the ring filler 16 in compression. In the present analyses, the ring filler such as 16 or 24 as well as the foundation are taken to be rigid. Correspondingly, $k_e = 10^6$ lb/in$^2$ is used, as for the case with no preuplift.

The nonlinear springs define the boundary conditions for vertical displacements at the base of the tank. Boundary conditions for two components of horizontal displacement and for the rotation about the circumferential axis remain to be specified. Since the in-plane stiffness of the base plate is large, the horizontal displacements at the base are assumed negligible. The rotation about the circumferential axis on the other hand is taken to be unrestrained. These assumptions are made only for the analysis of the shell. In the axisymmetric analysis of the base plate, the boundary conditions at the edge are determined from the solution for a cylindrical shell with loads applied at the edges.

In the linearized shell equations, all degrees of freedom except for the vertical displacement at the base can be eliminated by static condensation. As a result, the problem of the tank 10 or 20 on a ring of nonlinear Winkler springs, reduces to a single equation for the Fourier coefficients of the vertical displacement at the bse valid on every point on the circumference. This equation is to be solved for a finite number, N, of Fourier coefficients using Galerkin's method. In order to avoid locking problems due to the very stiff foundation, and ill-conditioning, the ring of Winkler springs was replaced by N discrete Winkler springs at nodal points to be used as the unknowns instead of the Fourier coefficients of the displacements. The result is N nonlinear algebraic equations, which were solved by Newton iteration. Once the displacements at nodal points are obtained, the vertical force at those points can be calculated from the force deflection relation for the Winkler springs.

To verify the assumption of weak circumferential variations, the two-dimensional nonlinear contact problem for the base plate requires a solution. This was achieved with the finite difference energy method, using a Fourier expansion for the circumferential variation of the displacements. Whereas for the bifurcation buckling analyses of Bushnell, supra, only the 0th Fourier coefficient of displacements (axisymmetric displacements) are allowed to be finite, and higher Fourier coefficients are infinitesimal, here all Fourier coefficients can take finite values. This introduces coupling between the Fourier coefficients of different order and makes for a large amount of computational effort.

In the analysis of a 15' tall by 7'-9' in diameter aluminum tank tested at the University of California at Berkeley it was found that the results obtained with the approximate method were in close agreement with those from the more comprehensive approach of this invention. Since that tank is similar in geometry to the mylar tank 20 under consideration, the approximate method is used to obtain the theoretical results reported in FIG.'s 5–9.

The theoretical and experimental values of the uplift obtained with and without preuplift are shown in FIG. 5 as a function of the tilt angle of tilt table 26. For the preuplifted case, the uplift shown in FIG. 5 includes the preuplift. The uplift due to tilting is much smaller for the preuplifted case. Also, for tilt angles greater than about 10°, both theory and experiment indicate that the total uplift is less for the preuplifted case.

The agreement between theory and experiment for the case without preuplift is excellent. However, two compensatory effects may have been involved: On one hand it was found that the approximate method of analysis, based on the assumption of weak circumferential variations in the base plate, yields a maximum uplift slightly (10to 20%) smaller than that from the more comprehensive analysis. On the other hand, the stiffness of the bead of epoxy, which bonds the base plate 22 to the shell 21, and the stiffness of a small extension of the base plate on the outside of the tank wall were neglected in the analysis.

For the case with preuplift, FIG. 5 indicates that uplift due to tilting is less than predicted by the analysis. Perhaps one of the more important contributing factors to this difference is the stiffening effect of the bead of epoxy at the edge. When the tank is uniformly uplifted all around the circumference, the edge tends to move radially inward. Due to the restraining action of the shell 21 and the bead of epoxy, there is a radial membrane tension in the base plate. For a larger radial tension at the edge, more membrane action is developed in the base plate, and the hold down force for a given amount of uplift is increased. This means that the restraining action due to the axial stiffness of the bead of epoxy will tend to decrease the uplift for a given water level and tilt angle.

Figure 6:
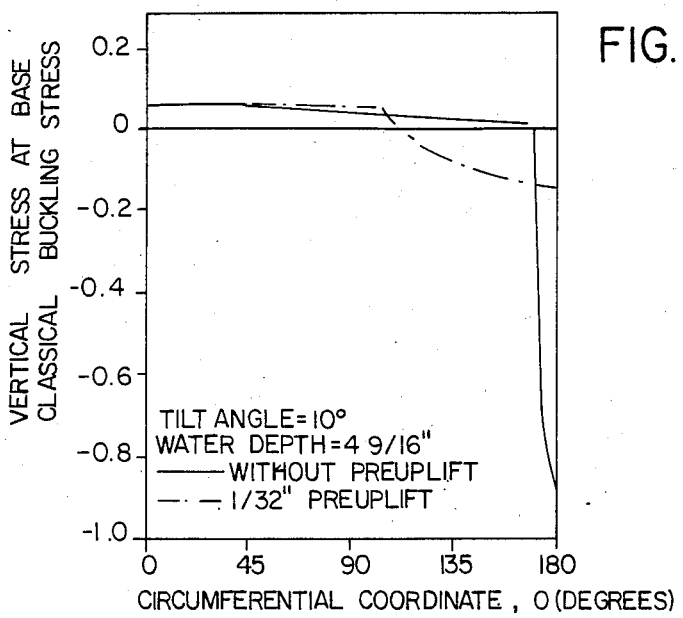
FIG. 6 is a plot of theoretical distribution of vertical stresses in the tank wall at the base.

The axial stresses at the base, as obtained by analysis, for a water level of 49/16" and a tilt angle of 10° are shown in FIG. 6. The stresses are expressed as a fraction of what is generally referred to as the classical buckling stress, given by:

$$f_{CL}=[3(1-\nu^2)]^{-\frac{1}{2}}Et/R \quad (1)$$

in which E, $\nu$, t, R are Young's modulus, Poisson's ratio, the thickness and the radius of shell, respectively, The location on the circumference is defined by an angle $\theta$, which is measured from the axis of loading, with $\theta=0$ on the side which is subject to uplift. Clearly, the maximum compressive stress at $\theta=180°$ is dramatically reduced by preuplift. No attempt was made to measure the stresses in the mylar material. However, for the tall aluminum tank tested at the University of California Berkeley by Clough, good agreement (within 10–20%) was obtained between theoretical and experimental peak compressive stresses.

The stress distribution in FIG. 6 suggest that buckling due to the vertical compressive stress would occur at a higher tilt angle and/or water level if the tank is preuplifted. This is confirmed by the experimental data in FIG. 7, where the tilt angle for a given water depth at buckling is seen to be 1.5 to 2.0 times larger for the case with preuplift. Since the lateral load is approximately proportional to the tilt angle, this means that the preuplift increases the lateral load capacity by a factor of up to 2.

In order to obtain the theoretical tilt angles and water depths at buckling, it was assumed that the shell buckles when the peak vertical compressive stress reaches the classical buckling stress given in Eq. (1). This assumption is open to debate. On one hand, prior art experiments on cylindrical shells in uniform axial compression indicate that the buckling loads are extremely sensitive to imperfections in the shell, and may be as less than half of the classical buckling load. On the other hand it was found in tilt tests on anchored mylar tanks, that the calculated peak compressive stress at buckling was about 1.24 times the classical value. Shih, supra also discusses how the nonuniformity in the pre-buckling stress field can result in higher buckling stresses. For an unanchored tank, it might be expected that this effect of nonuniformity is even more pronounced, because the region of large vertical compressive stresses is smaller.

The theoretical tilt angles and water levels at buckling, obtained with the classical buckling criterion, are shown in FIG. 7, by broken lines. They confirm that preuplift substantially increases the lateral load capacity. Also, the agreement with the experimental data is certainly acceptable, if one considers the uncertainties in the buckling stress.

The calculated peak compressive stress at the tilt angles and water levels for which incipient buckling was observed in the experiments will be referred to as the experimental buckling stress. The ratios of these experimental buckling stresses to the classical value of Eq. (1) are plotted in FIG. 8. The average value is 0.83 as indicated by the broken line. FIG. 8 also indicates that neither the internal pressure (which is proportional to the water level), nor the circumferential angle spanned by the contact region, or whether or not the tank is preuplifted seem to have any significant influence on the experimental buckling stress.

Both the theoretical and experimental results presented show that preuplift substantially increases the capacity of an unanchored tank to withstand lateral loads due to tilting. There is little doubt that the same conclusion would apply for seismic lateral loads.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. The method of providing stability for unanchored fluid storage tanks of the type having upstanding side walls and a ground supported base plate to balance seismically induced overturning moments comprising inserting a ring filler under the tank wall to partly preuplift said baseplate whereby the weight of the fluid resting on the preuplifted portion of said base plate will contribute to the resisting moment to said seismically induced overturning moment without any additional uplift of said tank wall.

2. The method according to claim 1 wherein said side wall is cylindrical and said ring filler is a cylindrical ring.

3. A combination unanchored fluid storage tank and preuplift means to balance seismically induced overturning moments comprising:

(a) tank having an upstanding side wall and a ground supported base plate; and (b) a preuplift means comprising a ring filler inserted under said upstanding side wall to preuplift said baseplate adjacent said side wall whereby the preuplifted portion of said base plate will contribute to the resisting moment to said seismically induced overturning moment without any additional uplift of said tank side wall.

4. A combination unanchored fluid storage tank and preuplift means according to claim 1 wherein said tank side wall is cylindrical and said preuplift means is a cylindrical ring.

* * * * *

UNITED STATES PATENT AND TRADEMARK OFFICE

CERTIFICATE OF CORRECTION

PATENT NO. : 4,697,395

DATED : October 6, 1987

INVENTOR(S) : Ralf Peek

It is certified that error appears in the above-identified patent and that said Letters Patent is hereby corrected as shown below:

Column 4, line 8, 49/16" should read -- 4-9/16" --.

Column 4, line 40, "formation" should read -- formulation --.

Column 7, line 7, 49/16" should read -- 4-9/16" --.

Column 7, line 44, the word "as" should be deleted.

In the Drawings

Title to Figs. 6, 8 and 9 should read as follows:

Fig. 6, VERTICAL STRESS AT BASE should read VERTICAL STRESS AT BASE
CLASSICAL BUCKLING STRESS CLASSICAL BUCKLING STRESS Fig. 8, EXPERIMENTAL BUCKLING STRESS should read EXPERIMENTAL BUCKLING STRESS
CLASSICAL BUCKLING STRESS CLASSICAL BUCKLING STRESS Fig. 9, EXPERIMENTAL BUCKLING STRESS should read EXPERIMENTAL BUCKLING STRESS
CLASSICAL BUCKLING STRESS CLASSICAL BUCKLING STRESS

Signed and Sealed this

Eighteenth Day of October, 1988

*Attest:*

DONALD J. QUIGG

*Attesting Officer*

*Commissioner of Patents and Trademarks*